United States Patent [19]

Nakagawa

[11] 4,231,118

[45] Nov. 4, 1980

[54] HEAD AND FACE PROTECTING HOOD

[76] Inventor: Yoshimasa Nakagawa, Urawa, Japan

[21] Appl. No.: 28,799

[22] Filed: Apr. 10, 1979

[30] Foreign Application Priority Data

Apr. 10, 1978 [JP] Japan ..... 53-46922
Apr. 10, 1978 [JP] Japan ..... 53-46923

[51] Int. Cl.[3] ..... A42B 1/04; A62C 39/00; A62B 23/00

[52] U.S. Cl. ..... 2/7; 2/205; 128/577

[58] Field of Search ..... 2/205, 202, 206, 171, 2/7; 128/142.6, 146.6

[56] References Cited

U.S. PATENT DOCUMENTS

| | | | |
|---|---|---|---|
| 996,739 | 7/1911 | Vinton | 2/205 |
| 3,521,630 | 7/1970 | Westberg | 128/142.6 X |
| 3,789,839 | 2/1974 | Lund et al. | 2/206 X |
| 4,098,270 | 7/1978 | Dolby | 128/142.6 X |
| 4,141,703 | 2/1979 | Mulchi | 128/142.6 |

FOREIGN PATENT DOCUMENTS

| | | | |
|---|---|---|---|
| 348733 | 5/1937 | Italy | 128/142.6 |

*Primary Examiner*—Peter P. Nerbun

*Attorney, Agent, or Firm*—Wenderoth, Line & Ponack

[57] ABSTRACT

This invention is directed to a head and face protecting hood which includes a cover body having front and rear walls each being having an outer layer of a laminate of non-flammable polyvinyl chloride sheet and non-flammable fiber sheet and an inner layer of adiabatic non-woven fiber sheet which is adhered to only the edges of the outer layer of each of the front and rear walls so as to cover a whole head and face. An eye facing body is provided which is adhered to the front wall of the cover body and is made of a non-flammable transparent polyvinyl chloride layer. A mouthpiece facing the front wall of body may be also provided which is mounted on the front wall of the cover body and has a front composite layer, a rear composite layer and a poison absorption agent covered with an adiabatic fiber layer disposed therebetween. The front and rear composite layers each have a first layer portion made of a laminate of perforated non-flammable polyvinyl chloride sheet and permeable non-flammable fiber sheet and a second layer portion of permeable adiabatic non-woven fiber layer which is adhered only to the edges of the first layer portion.

5 Claims, 5 Drawing Figures

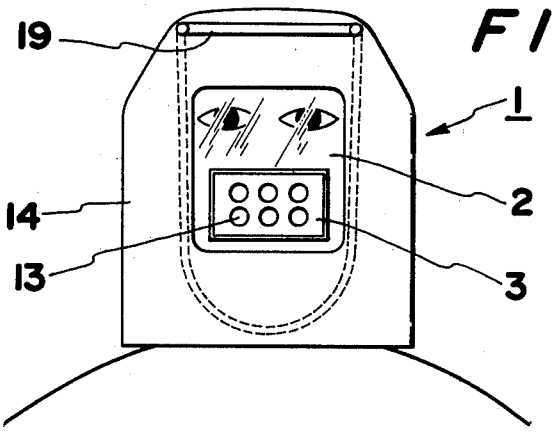
FIG. 3
FIG. 4
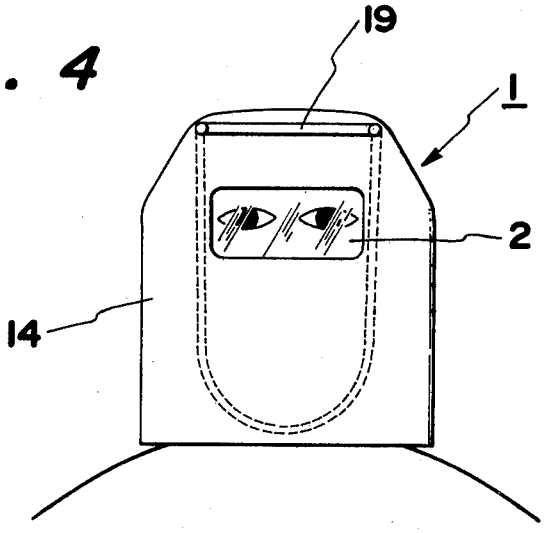

HEAD AND FACE PROTECTING HOOD

BACKGROUND OF THE INVENTION

There have been various different types of hoods used for protecting the head and face from fire, smoke and poisonous gases. The of the prior art however, are constructed in a complicated manner and therefore, in case of emergency and in situations where people do not have in a calm frame of mind due to terror or fear of the fire, it requires a lot of time to put on such prior art hoods.

Although there have been proposed hoods which can be put on easily, such hoods have generally been made of poor adiabatic material or constructed in a poor adiabatic manner. Thus, such hoods tend to catch fire easily when used in a fire, which results in the face or head of the person using it getting scalded or burned. In the worst of cases, the use of such hoods results in the person's death.

Further, since the hoods of the prior art have no means to protect a person from poisonous or noxious gases, there results a difficulty in breathing which causes the person's death or disablement due to gas poisoning.

SUMMARY OF THE INVENTION

Accordingly, it is a principal object of the present invention to provide a head and face protecting hood which is adapted to protect the head and face of a person from fire so that they are not scalded or burned.

It is another object of the invention to provide a head and face protecting hood which is constructed so that breathing in of poisonous gases such as carbon monoxide and gasses resulting from combustion of new building materials can be avoided thereby allowing the user to continue normal breathing.

It is another object of the present invention to provide a head and face protecting hood which is adapted to allow a wide field of vision so that a person can flee rapidly to safety.

It is another object of the invention to provide a head and face protecting hood which is adapted to be easily and rapidly put on even in case of emergency such as fire and earthquake.

It is a further object of the invention to provide a head and face protecting hood which is adapted to prevent breathing in of poisonous gases and dust in the atmosphere of an area where they are produced so that work can be sanitarily performed in the area while an adequate field of vision is maintained.

In accordance with one embodiment of the invention, there is provided a head and face protecting hood which includes body having a front wall and a rear wall, each made of an outer layer of a laminate of non-flammable polyvinyl chloride sheet and non-flammable fiber sheet, and an inner layer of adiabatic sheet which is adhered only to the edges of said outer layer of each of the front and rear walls so as to cover the whole head and face; and an eye piece body is secured to the front wall of said cover body and is made of a non-flammable transparent polyvinyl chloride layer.

In accordance with another aspect of the invention, there is provided a head and face protecting hood which includes a cover body having a front wall, and a rear wall each made of an outer layer of a laminate of non-flammable polyvinyl chloride sheet and non-flammable fiber sheet and an inner layer of adiabatic sheet which is adhered only to the edges of said outer layer front and rear walls for covering the whole head and face; an eye piece body is secured to the front wall of said cover body and is made of a non-flammable transparent polyvinyl chloride layer; and a mouth piece body is mounted on the front wall of said cover body and has a front composite layer, a rear composite layer and a poison absorbing agent covered with an adiabatic fiber layer disposed between the front and rear composite layers, said front and rear composite layers each being made of a first layer portion of a laminate of perforated non-flammable polyvinyl chloride sheet and permeable non-flammable fiber sheet and a second layer portion of permeable adiabatic layer adhered only to the edges of said first layer portion.

BRIEF DESCRIPTION OF THE DRAWINGS

The above and other objects and features and the present invention will be understood by those skilled in the art from the description of the various embodiments of the invention taken along with the accompanying drawings in which:

FIG. 3 is a front view of a head and face protecting hood constructed in accordance with another embodiment of the invention;

FIG. 4 is a front view of a head and face protecting hood constructed in accordance with still another embodiment of the invention.

DETAILED DESCRIPTION OF THE EMBODIMENTS

Figure 1:
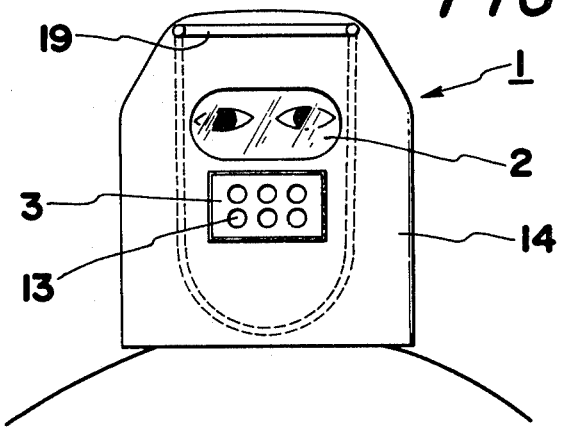
FIG. 1 is a front view of a head and face protecting hood constructed in accordance with one embodiment of the invention.
Figure 2:
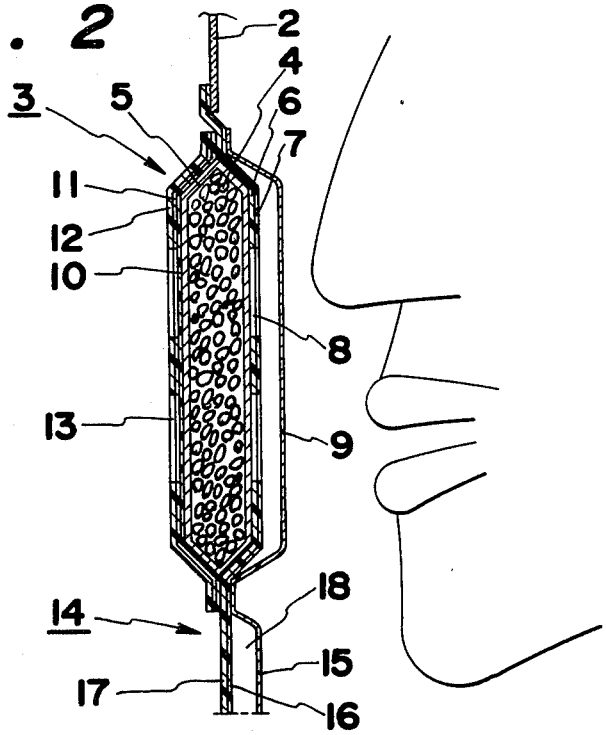
FIG. 2 is an enlarged sectional view of the hood taken along the line A–A′ of FIG. 1.

As shown in FIGS. 1 and 2, the head and face protecting hood 1 of the invention includes a cover body 14 having a front wall 14A and a rear wall (not shown) which opens at the lower end thereof to cover the whole head, face neck of a person. The hood seals against the neck and body by conventional means to prevent noxious gases and smoke from entering therein. The front and rear walls of the cover body 14 are each made of an outer layer of a laminate of non-flammable polyvinyl chloride sheet 17 and non-flammable fiber sheet 16 and an inner layer 15 of an adiabatic non-woven fiber sheet welded or stuck only to the peripheral edges of the outer layer of each of the front and rear walls, so that a space 18 is formed between the outer and inner layers. A person can put on the hood 1 through the opening provided at the lower end thereof.

A hood securing member 19 may be provided on the hood, and in the illustrated embodiment, it may comprise an elastic tape at both ends riveted to the upper portion of the cover body 14. This hood securing member 19 is engaged by the jaw of the person so that the hood 1 is prevented from being removed from the head and face.

An eye facing body 2 is attached to the front wall 14A of the cover body 14 and is made of a non-flammable transparent polyvinyl chloride layer. This eye piece body 2 serves to maintain an adequate field of vision when the wearer flees for safety.

As shown in FIG. 2, a mouth piece body 3 is provided on the front wall of the cover body 14 and has a front composite layer 3A, a rear composite layer 3B and a core 3C disposed between the front and rear composite layers 3A and 3B. The front composite layer 3A is made of a first layer portion of a laminate of non-flammable polyvinyl chloride sheet 12 having a plurality of perforations 13 and a permeable non-flammable fiber sheet 11 and a second layer portion of a permeable adiabatic film-like non-woven fiber layer 10 are adhered only to the edges of the first layer portion so as to form a space between the layer portions. Also, the rear composite layer 3B is made of a first layer portion of a laminante of non-flammable polyvinyl chloride sheet 6 and non-flammable fiber sheet 7 both having a plurality of perforations 8 and a second layer portion made of a permeable adiabatic film-like non-woven fiber sheet 9 such as span lace which adheres only to the edges of the first layer portion so as to form a space between the layer portions. As shown in FIG. 2, the second layer portion 9 of the rear composite layer 3B may be made integral with the inner layer 15 of adiabatic non-woven fiber sheet. Also, the laminate of the sheets 6 and 7 of the first layer portion of the rear composite layer 3B may be made integral with the outer layer of the cover body front wall 14A.

The core 3C is composed of a poison absorbing agent 4 such as activated carbon, zeolite, Dowsonite and the like. The poison absorbing agent is covered with or contained within an adiabatic non-woven fiber layer 5. Zeolite has fine holes in the order of a micron, and a surface area of about 600 $m^2/g$, and serves to remove viruses having a size of about 20 to 260 m/m micron, out of gases through the mouth facing body 3 by means of molecular filter action and absorbs or catches carbon monoxide, carbon dioxide, ammonia, virus, sulfur oxide, nitrogen oxide and the like. In addition, electrons are transferred between zeolite and the gases of carbon monoxide or carbon dioxide which generates absorption heat, which enhances the chemical absorption of the poison. When Dowsonite is used, it serves to absorb hydrochloric acid gases more effectively than when activated carbon is used.

Figure 5:
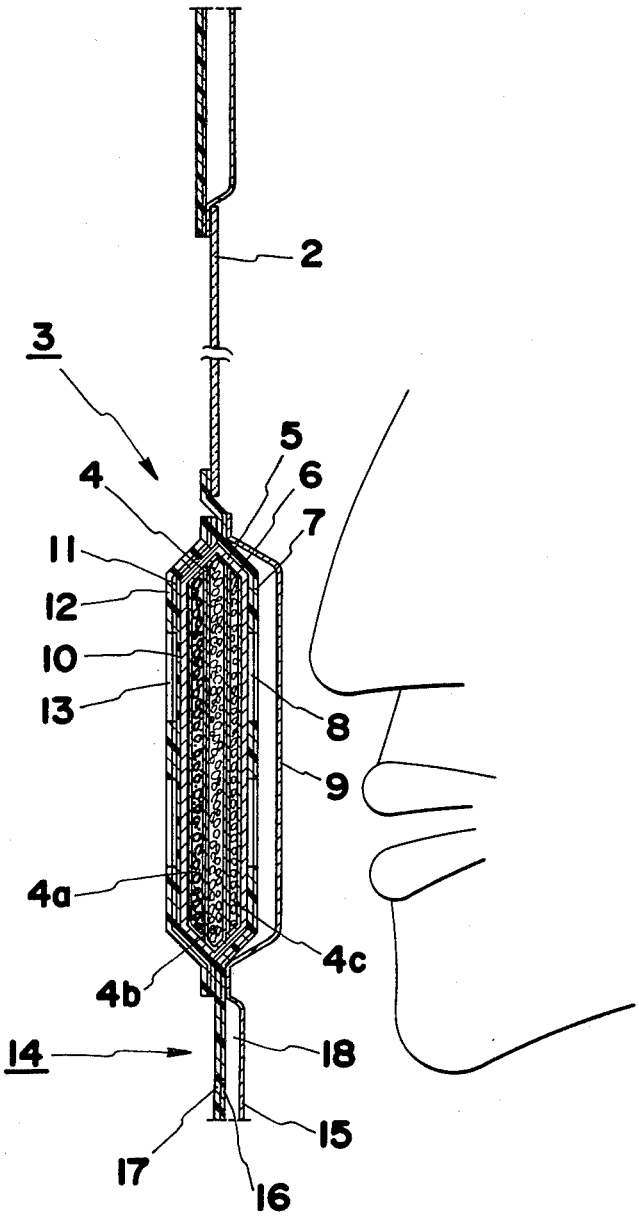
FIG. 5 is an enlarged sectional view of a modification of the mouth piece body used in the invention.

Activated carbon, zeolite and Dowsonite may be separately covered with the adiabatic non-woven fiber layer 5, and all of them may be located between the front and rear composite layers 3A and 3B. Alternately, two of them may be provided between the front and rear composite layers 3A and 3B, or a mixture of activated carbon zeolite and Dowsonite may be covered with the adiabatic non-woven fiber layer 5 and disposed between the front and rear composite layers 3A and 3B. Otherwise, as shown in FIG. 5, Dowsonite 4a which serves to absorb chlorine gases may be used as the outermost layer of the body 3, the absorption agent which serves to absorb carbon monoxide gases placed in the middle of the body 3 and Zeolite which serves to absorb normal poisonous gases placed at the innermost of the body 3. The carbon monoxide absorption agent may be alumina hydrate which comprises $Al_2O_3$, $SiO_2$, NaO, $Fe_2O_3$ and $TiO_2$ and serves to effectively absorb CO. NaO may be omitted.

FIG. 3 shows another embodiment of the head and face protecting hood 1. In this hood 1, the eye facing body 2 has a larger area to cover themost part of the face and the mouth face body 3 is mounted on the cover body 1 through the non-flammable polyvinyl chloride sheet of the eye facing body 2.

FIG. 4 shows another embodiment of the head and face protecting hood 1 in which the mouth facing body 3 is omitted. This hood can be used for fleeing for safety in a short time.

As noted by those skilled in the art, the head and face protecting hood may be preferably formed of soft or flexible materials so that it can be folded in a compact manner so as to be contained in a case or a bag when it is in custody or carried.

Although the inner layer 15 of the second layer portion 9 is formed of adiabatic non-woven fiber sheet, it may be formed of adiabatic other perfora ted sheet such as cloth, pulp, asbestos. It will be noted that such materials for mouth facing body 3 should have a permeability.

When a fire occurs for various causes such as earthquake, people put on the head and face protecting hood 1 and flee for safety. Since the cover body 14, the eye facing body 2 and the mouth facing body 3 are formed of non-flammable materials, the hood 1 cannot be burned. It should be noted that the non-flammable fiber and polyvinyl chloride sheets have the property estinguish fire by themselves. In addition, since an air space exists between the outer and inner layers, the adiabatic effect of the hood is improved over those of the prior art.

The eye piece body 2 is made of a transparent material, and therefore, the wearer can flee for safety with a full wide field of vision.

The mouth piece body 3 serves to absorb smoke, poisonous gases and creates clean air, which permits the wearer to breath easily while taking shelter in a safe place. Thus, in a place where buildings are concentrated or in an underground market, people putting on the hood of the present invention can take shelter without having any difficulty in breathing and without breathing in any poisonous gases which tend to be produced from new building materials such as chemical fibers, synthetic resins and the like. Thus, it will be further noted that the wearer will never becomes scalded or burned due to gas poisoning.

The heat and face protecting hood 1 of the invention may be always carried by a person in a compact form. Also, the hood of the present invention may be kept in various buildings such as households, companies, hospitals, underground markets, apartment houses, department stores, hotels, schools, ships, construction sites and various factories.

Although several embodiments of the present invention have been described with reference to the accompanying drawings, it will be understood that they are by way of example, only and that various changes and modifications may be made without departing from the spirit and scope of the invention, which is intended to be defined only by the claims which follow.

What is claimed is:

1. A head and face protecting hood comprising:

an outer cover body made up of a front wall and a rear wall, said walls being attached to each other at edges thereof except at the bottom edges through which the wearer's head fits for putting the hood on;

said front and rear walls having an outer layer which is made of a laminate of non-flammable polyvinyl chloride sheet and non-flammable fiber sheet and having an inner layer spaced from said outer layer attached to the edges of said front and rear wall outer layer, said inner layer being made of adiabatic material and extending so as to cover the whole head and face of the wearer; and an eyepiece positioned in front of the eyes which is secured to said front wall of said cover body, said front wall having an opening for fitting said eyepiece being made of a non-flammable transparent polyvinyl chloride material for allowing vision therethrough.

2. A head and face protecting hood comprising:

an outer cover body made up of a front wall and a rear wall, said walls being attached to each other at edges thereof except, at the bottom edges through which the wearer's head fits for putting the hood on;

said front and rear walls having an outer layer which is made of a laminate of non-flammable polyvinyl chloride sheet and non-flammable fiber sheet and having an inner layer spaced from said outer layer attached to the edges of said front and rear wall outer layer, said inner layer being made of adiabatic material and extending so as to cover the whole head and face of the wearer;

an eyepiece body positioned in front of the eyes and which is secured to said front wall of said cover body, said front wall having an opening for fitting said eyepiece body therein, said eyepiece body being made of a non-flammable transparent polyvinyl chloride material for allowing vision therethrough;

a mouthpiece body facing the mouth and which is secured to said front wall below said eyepiece body, said mouthpiece body having a front and rear composite layer, each of said front and rear composite layers having a first layer portion made of a laminate of perforated non-flammable fiber sheet and a second layer portion made of a permeable adiabatic material, said second layer portion being adhered to said first layer portion at the edges thereof; and a poison absorbing agent which is contained within and covered by an adiabatic fiber layer being disposed between said front and rear composite layers.

3. A head and face protecting hood as claimed in claim 2 wherein said eyepiece body has a size for covering most of the face and further having said mouthpiece body being mounted on and through said eyepiece body below the eyes and in front of the mouth.

4. A head and face protecting hood as claimed in claim 2 wherein said poison absorbing agent comprises: a chlorine absorbing agent which is disposed at the outer most portion of said second body, a carbon monoxide absorbing agent which is disposed in the middle of said second body and a zeolite which is disposed at the innermost portion of said second body, each of said chlorine absorbing agent, carbon monoxide absorbing agent and zeolite being separately covered with said adiabatic fiber layer.

5. A head and face protecting hood as claimed in claim 2 wherein said inner layer of said front and rear portions of said cover body and said second layer portion of said composite layers of said second body are made of non-woven fiber.

* * * * *